US011432068B2

(12) United States Patent
Ballagas et al.

(10) Patent No.: US 11,432,068 B2
(45) Date of Patent: Aug. 30, 2022

(54) VACUUM-BASED MICROPHONE SENSOR CONTROLLER AND INDICATOR

(71) Applicant: HEWLETT-PACKARD DEVELOPMENT COMPANY, L.P., Spring, TX (US)

(72) Inventors: Rafael Ballagas, Palo Alto, CA (US); Mary G. Baker, Palo Alto, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/606,268

(22) PCT Filed: Jun. 13, 2018

(86) PCT No.: PCT/US2018/037324
§ 371 (c)(1),
(2) Date: Oct. 18, 2019

(87) PCT Pub. No.: WO2019/240791
PCT Pub. Date: Dec. 19, 2019

(65) Prior Publication Data

US 2021/0329375 A1 Oct. 21, 2021

(51) Int. Cl.
*H04R 1/42* (2006.01)
*H04R 1/04* (2006.01)
*H04R 1/22* (2006.01)

(52) U.S. Cl.
CPC ..... *H04R 1/42* (2013.01); *H04R 1/04* (2013.01); *H04R 1/222* (2013.01)

(58) Field of Classification Search
None
See application file for complete search history.

(56) References Cited

U.S. PATENT DOCUMENTS 1,834,051 A 12/1931 De
3,939,758 A 2/1976 Faisandier
(Continued)

FOREIGN PATENT DOCUMENTS

CN 2738507 Y 11/2005
CN 102711029 A 10/2012
(Continued)

OTHER PUBLICATIONS

Cellini, Filippo, et al. "Large deformations and fluorescence response of mechanochromic polyurethane sensors." Mechanics of Materials 93 (2016): 145-162.

(Continued)

*Primary Examiner* — Walter F Briney, III
(74) *Attorney, Agent, or Firm* — Fabian VanCott

(57) ABSTRACT

An example system includes a microphone sensor for an electronic device and a chamber coupled to the microphone sensor. The chamber is to be selectively filled with a fluid or having a vacuum therein. When the chamber is filled with the fluid, sound waves are allowed to travel through the chamber to the microphone sensor, and fluid pressure in the chamber causes an indicator to be in a first position. When the chamber has a vacuum therein, sound waves are prevented from traveling through the chamber to the microphone sensor and the vacuum in the chamber causes the indicator to be in a second position different from the first position.

19 Claims, 6 Drawing Sheets

(56) References Cited

U.S. PATENT DOCUMENTS

| | | | | |
|---|---|---|---|---|
| 4,197,752 | A | 4/1980 | Block | |
| 6,806,593 | B2 | 10/2004 | Tai et al. | |
| 2003/0115965 | A1 | 6/2003 | Mittelstein et al. | |
| 2004/0039245 | A1* | 2/2004 | Jaeger | H04R 25/606 600/25 |
| 2005/0254673 | A1 | 11/2005 | Hsieh et al. | |
| 2008/0037815 | A1 | 2/2008 | Ito et al. | |
| 2015/0283335 | A1* | 10/2015 | Lin | A61M 5/14244 604/111 |
| 2015/0319534 | A1* | 11/2015 | Lippert | H04R 3/007 381/165 |
| 2016/0233912 | A1 | 8/2016 | Thomas et al. | |
| 2016/0381456 | A1 | 12/2016 | Doller | |
| 2017/0164084 | A1* | 6/2017 | Vitt | H04R 1/08 |
| 2018/0222659 | A1* | 8/2018 | Plazarte | B65D 81/2038 |

FOREIGN PATENT DOCUMENTS

| | | | | |
|---|---|---|---|---|
| CN | 204119468 | U | 1/2015 | |
| CN | 204482010 | U | 7/2015 | |
| EP | 1353161 | B1 | 10/2003 | |
| EP | 2390659 | A1 * | 11/2011 | G01N 29/28 |
| EP | 2390659 | A1 | 11/2011 | |
| EP | 2637007 | A1 | 9/2013 | |
| FR | 3037146 | B1 | 12/2016 | |
| UA | 10549 | | 12/1996 | |

OTHER PUBLICATIONS

Gokulraj Chandramohan, Electrical Characterization of MEMS Microphones, Aug. 2010, Delft University of Technology.

* cited by examiner

VACUUM-BASED MICROPHONE SENSOR CONTROLLER AND INDICATOR

BACKGROUND

Most electronic devices are provided with an audio subsystem which includes a microphone. The microphone may be provided to allow the electronic device to receive input from a user. For example, the microphone may be used during voice or video calls. Further, microphones may be used to provide instructions to the electronic device through a voice-recognition system. Thus, the user may provide voice commands to the device.

BRIEF DESCRIPTION OF THE DRAWINGS

For a more complete understanding of various examples, reference is now made to the following description taken in connection with the accompanying drawings in which.

DETAILED DESCRIPTION

As noted above, microphones are provided with many electronic devices for a variety of applications, such as phone calls or voice-recognition systems. Users often desire to mute the microphone for privacy or other various reasons. Mute functions on electronic devices typically include a selection by a user which uses software to de-activate the microphone. An indicator, such as a light-emitting diode (LED) may be provided to indicate the status of the microphone. The LED is typically controlled by software of the electronic device. Such arrangements may be prone to malfunction or hacking. Thus, while the LED may indicate to a user that the microphone is muted, the system may malfunction or be hacked such that the microphone remains activated.

Various examples described herein relate to privacy control and indication in electronic devices. In various examples, a chamber is formed around a microphone sensor. The chamber can be selectively filled with air or have a vacuum therein. With the chamber filled with air, sound waves can travel through the chamber and reach the microphone sensor. With a vacuum in the chamber, sound waves are unable to travel through the chamber. Thus, the chamber can be used to control operation of the microphone sensor. Additionally, the chamber is provided with an indicator that is directly responsive to the condition of the chamber. In this regard, air pressure in the chamber causes the indicator to move to a first position, while a vacuum in the chamber causes the indicator to move to a second position. In one example, the indicator is a membrane on one surface of the chamber. Air pressure in the chamber causes the membrane to a convex position, while a vacuum pulls the membrane to a concave position. In some examples, the membrane may change from a first color in the concave position to a second color in the convex position. Thus, the indicator can directly provide a user with the state of the chamber (either filled with air or with a vacuum) and the operability status of the microphone sensor.

Figure 1:
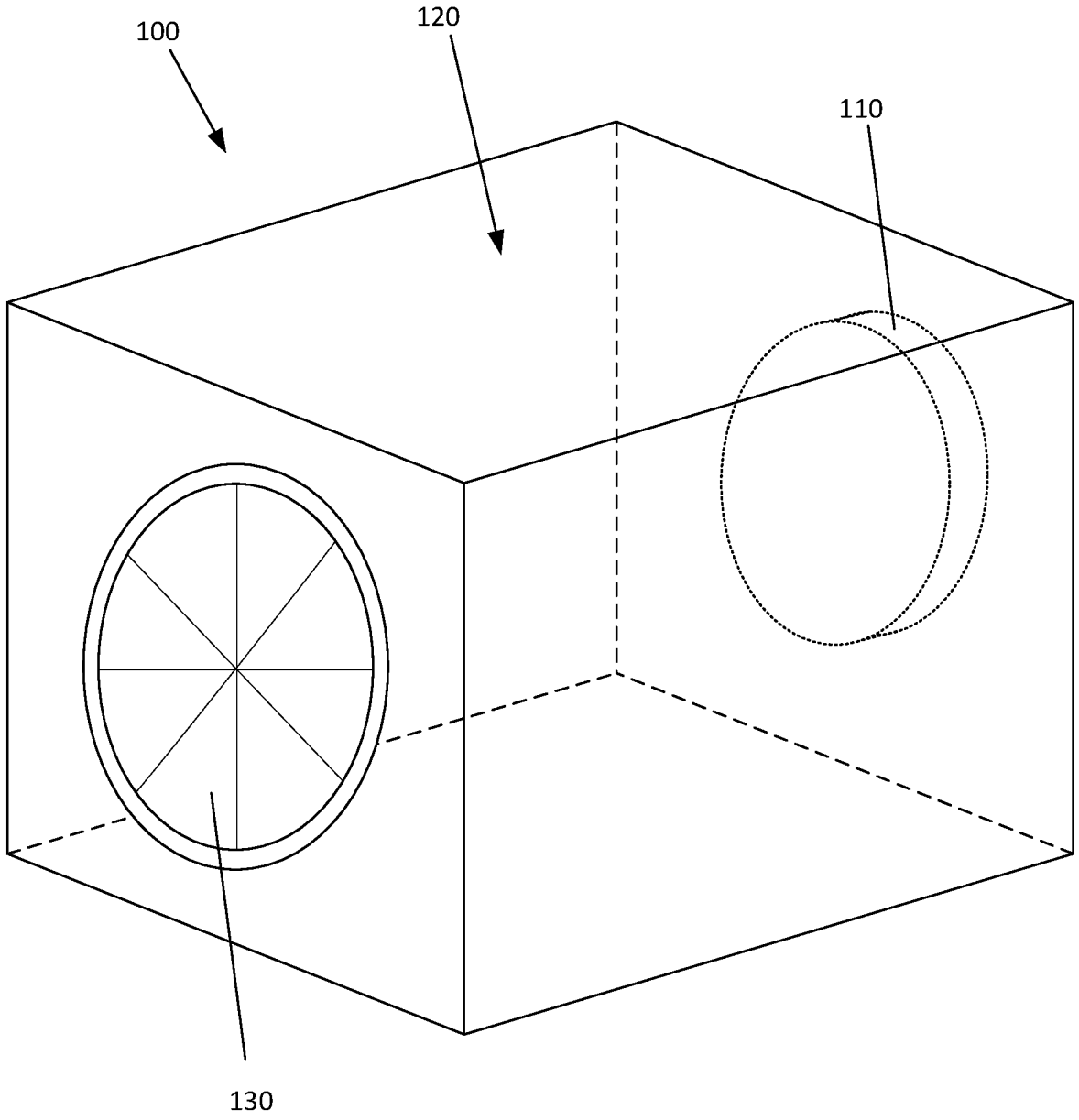
FIG. 1 illustrates an example microphone system.

Referring now to the Figures, FIG. 1 illustrates an example system 100. The example system 100 may be implemented in any of a variety of electronic device including, but not limited to, laptops, desktops, mobile phones, tablets, personal digital assistants or the like. Further, the example system 100 may be coupled to other systems or subsystems of the electronic device. For example, the example system 100 may be coupled to a processor and/or an audio subsystem of the electronic device.

The example system 100 includes a microphone sensor 110 for an electronic device. The microphone sensor 110 may be any of a variety of components which allow capturing of sounds waves. In one example, the microphone sensor 110 includes an acoustic-to-electric transducer which converts acoustic waves to electrical signals.

The microphone sensor 110 of the example system 100 is coupled to a chamber 120. The chamber 120 may be an air-tight chamber capable of selectively maintaining a vacuum therein or retaining a fluid therein. In this regard, the chamber 120 is to be selectively filled with a fluid or having a vacuum therein. As used herein, a fluid may be any liquid, gas or other substance which can be flowed into or out of the chamber. In various examples, the fluid may be selected from any of a variety of gases (e.g., air or nitrogen) or liquids (e.g., water). A port (not shown in FIG. 1) may be provided in the chamber 120 to allow insertion or evacuation of the fluid into/from the chamber 120. In various examples, a pump may be provided to facilitate movement of the fluid.

The condition of the chamber 120 serves to control operability of the microphone sensor 110. When the chamber 120 is filled with a fluid, sound waves are allowed to travel through the chamber to the microphone sensor 110. In this regard, the fluid in the chamber transmits the sound waves, or acoustic waves, through the chamber and to the microphone sensor 110. Conversely, when the chamber 120 has a vacuum therein, sound waves are prevented from traveling through the chamber 120 to the microphone sensor 110. With the chamber 120 evacuated, the chamber 120 is lacking a medium to transmit sound waves therethrough.

The example system 100 of FIG. 1 includes an indicator 130. In some examples, the indicator 130 is a flexible membrane forming at least a part of one surface of the chamber 120. The indicator 130 (e.g., flexible membrane) is responsive to the vacuum or fluid pressure in the chamber 120. In this regard, when the chamber 120 is filled with the fluid, the fluid pressure in the chamber causes the indicator 130 to be in a first position, and when the chamber 120 has a vacuum therein, the vacuum in the chamber 120 causes the indicator 130 to be in a second position different from the first position. For example, as described in various examples described below, in cases where the indicator is a flexible membrane, when the chamber 120 is filled with a fluid, the fluid pressure in the chamber 120 causes the flexible membrane to be in a first position, and when the chamber 120 is evacuated, the vacuum pressure in the chamber 120 causes the flexible membrane to be in a second position, where the first position is more concave (outward) relative to the second position.

Figure 2A:
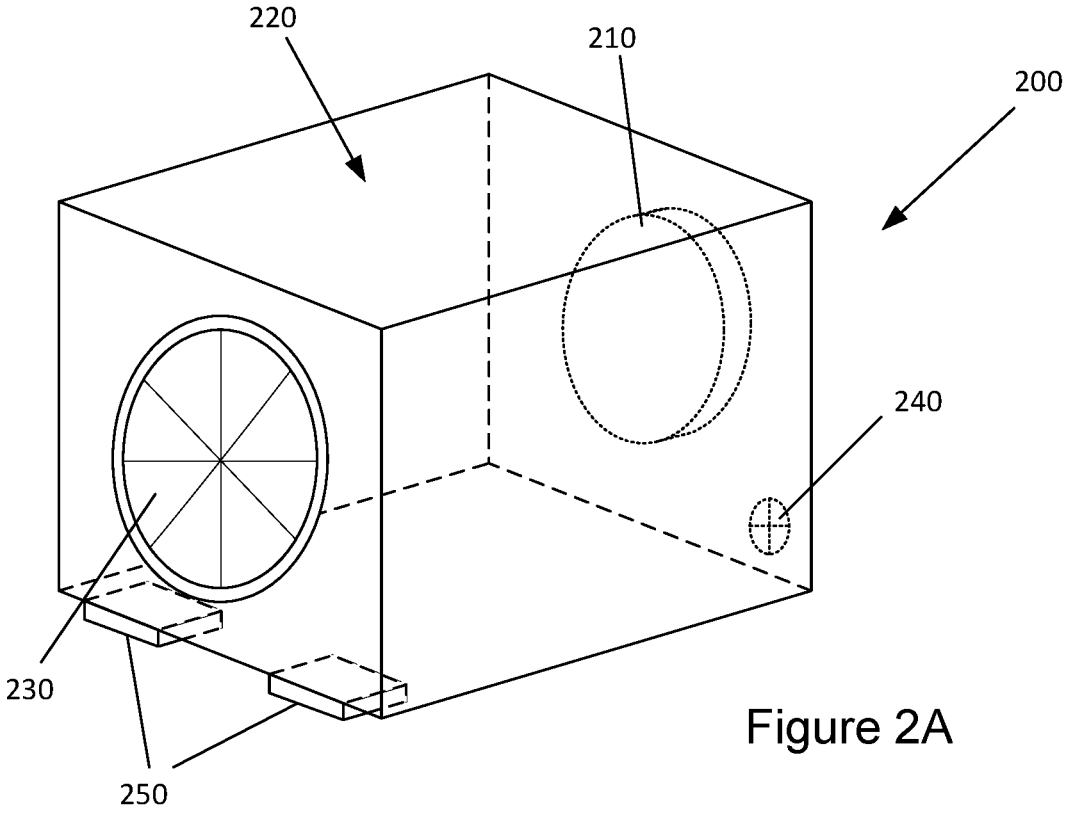
FIGS. 2A and 2B illustrate another example microphone system in the active and de-activated positions.
Figure 2B:
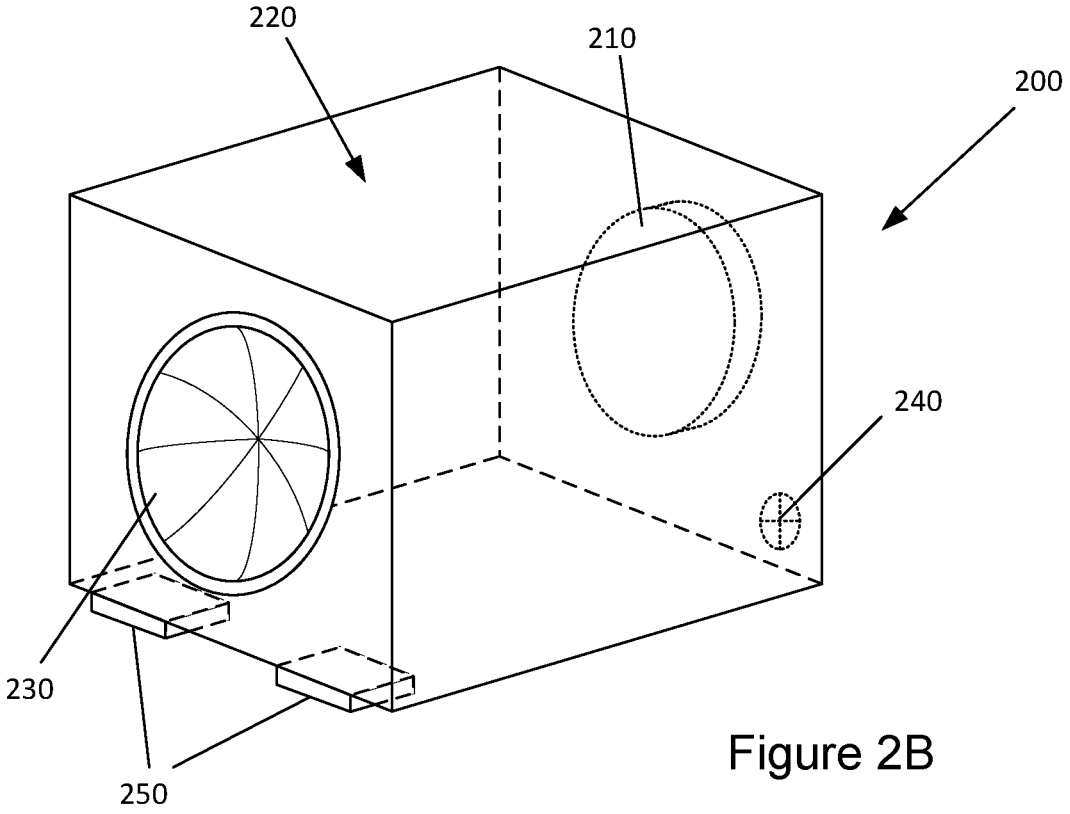

Referring now to FIGS. 2A and 2B, another example microphone system 200 is illustrated in the active position (FIG. 2A) and de-activated position (FIG. 2B). The example system 200 of FIGS. 2A and 2B is similar to the example system described above with reference to FIG. 1 and includes a microphone sensor 210, a chamber 220 and a flexible membrane 230 forming an indicator. The example illustrated in FIGS. 2A and 2B is shown with a port 240 to facilitate flow of a fluid into and out of the chamber 220 using, for example, a pump (not shown). The pump may be used to evacuate the chamber 220 or to fill the chamber 220 with a fluid. As described above, the fluid may include a gas (e.g., air or nitrogen) or a liquid (e.g., water).

In the activated position illustrated in FIG. 2A, the chamber 220 is filled with the fluid. Conversely, FIG. 2B illustrates the de-activated position in which the chamber 220 is evacuated. In the activated position of FIG. 2A with the chamber 220 filled with fluid, the fluid pressure in the chamber 220 causes the flexible membrane 230 to be in a first position. In the example of FIG. 2A, in the first position, the flexible membrane 230 is substantially flat. In the de-activated position of FIG. 2B with the chamber 220 evacuated, the vacuum pressure in the chamber 220 causes the flexible membrane 230 to be in a second position. In the example of FIG. 2B, in the second position, the flexible membrane 230 forms a concave surface (inward, or into the chamber 220). As noted above, the first position (substantially flat) is more concave relative to the second position (concave).

In some examples, the flexible membrane 230 is formed of a material that changes color in response to change in surface tension. For example, the surface tension in the concave position of FIG. 2B may be greater than the surface tension in the substantially flat position of FIG. 2A. Thus, the flexible membrane 230 may have one color in the substantially flat position (e.g., green) and a different color in the concave position (e.g., red).

In some examples, the flexible membrane 230 is formed of a shape memory material which is formed to have one natural shape. The flexible membrane 230 may change from its natural shape with application of a force. For example, the flexible membrane 230 in the example system 200 of FIGS. 2A and 2B may have a natural shape that is flat as shown in FIG. 2A. With the evacuation of the chamber 220, a negative pressure within the chamber 220 may apply a sufficient force to cause the flexible membrane 230 to change its shape to a concave shape, as shown in FIG. 2B.

In some examples, additional features may be provided to acoustically isolate the example system 200 and, in particular, the microphone sensor 210 from sound waves. Such acoustic isolation features may take any of a variety of forms. In various examples, the acoustic isolation features may include insulating material surrounding or supporting the example system. For example, as illustrated in FIGS. 2A and 2B, the example system 200 may be provided with wave absorbing pads 250 that are coupled to the chamber 220. In this regard, the wave absorbing pads 250 may be used to mount the chamber 220 and the example system 200 to a housing of an electronic device. The wave absorbing pads 250 may ensure that any sound waves reaching the microphone sensor 210 travel through the chamber 220 by eliminating or reducing sound waves that may travel as vibrations though the housing.

Figure 3A:
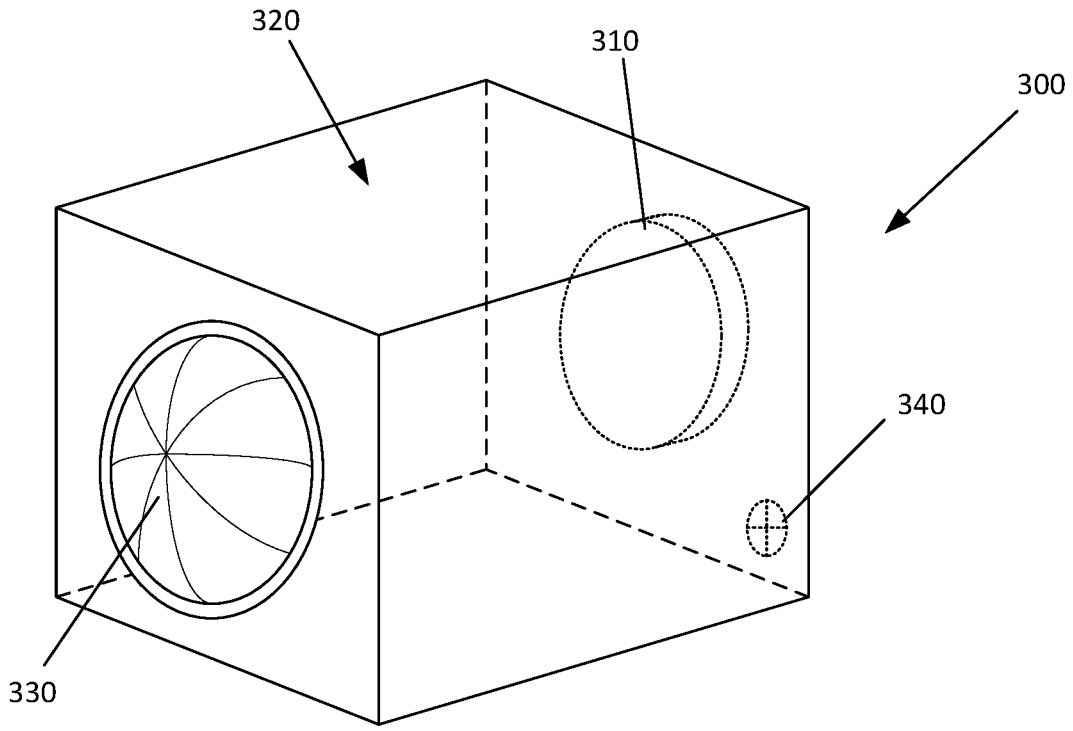
FIGS. 3A and 3B illustrate another example microphone system in the active and de-activated positions.
Figure 3B:
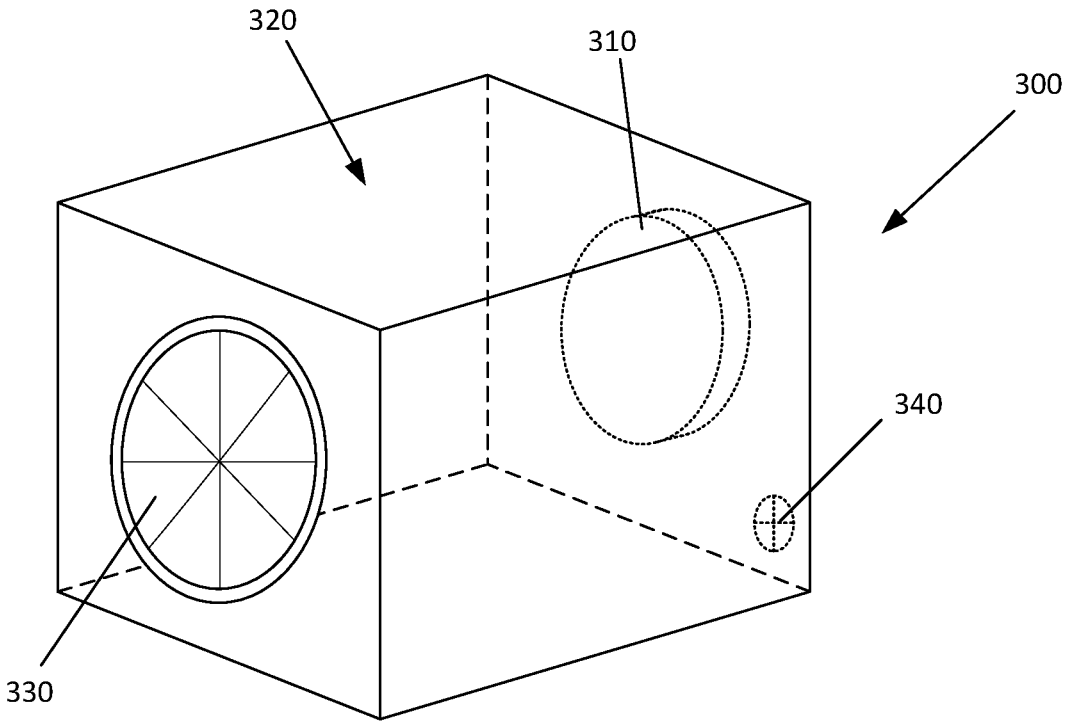

Referring now to FIGS. 3A and 3B, another example microphone system 300 is illustrated in the active position (FIG. 3A) and de-activated position (FIG. 3B). The example system 300 of FIGS. 3A and 3B is similar to the example systems described above with reference to FIGS. 1, 2A and 2B and includes a microphone sensor 310, a chamber 320 and a flexible membrane 330 forming an indicator. The example illustrated in FIGS. 3A and 3B is shown with a port 340 to facilitate flow of a fluid into and out of the chamber 320.

In the activated position illustrated in FIG. 3A, the chamber 320 is filled with the fluid. Conversely, FIG. 3B illustrates the de-activated position in which the chamber 320 is evacuated. In the activated position of FIG. 3A with the chamber 320 filled with fluid, the fluid pressure in the chamber 320 causes the flexible membrane 330 to be in a first position. In the example of FIG. 3A, in the first position, the flexible membrane 330 forms a convex surface (outward, or out of the chamber 320). In the de-activated position of FIG. 3B with the chamber 320 evacuated, the vacuum pressure in the chamber 320 causes the flexible membrane 330 to be in a second position. In the example of FIG. 3B, in the second position, the flexible membrane 330 is substantially flat. Again, as noted above, the first position (concave) is more concave relative to the second position (substantially flat).

Figure 4A:
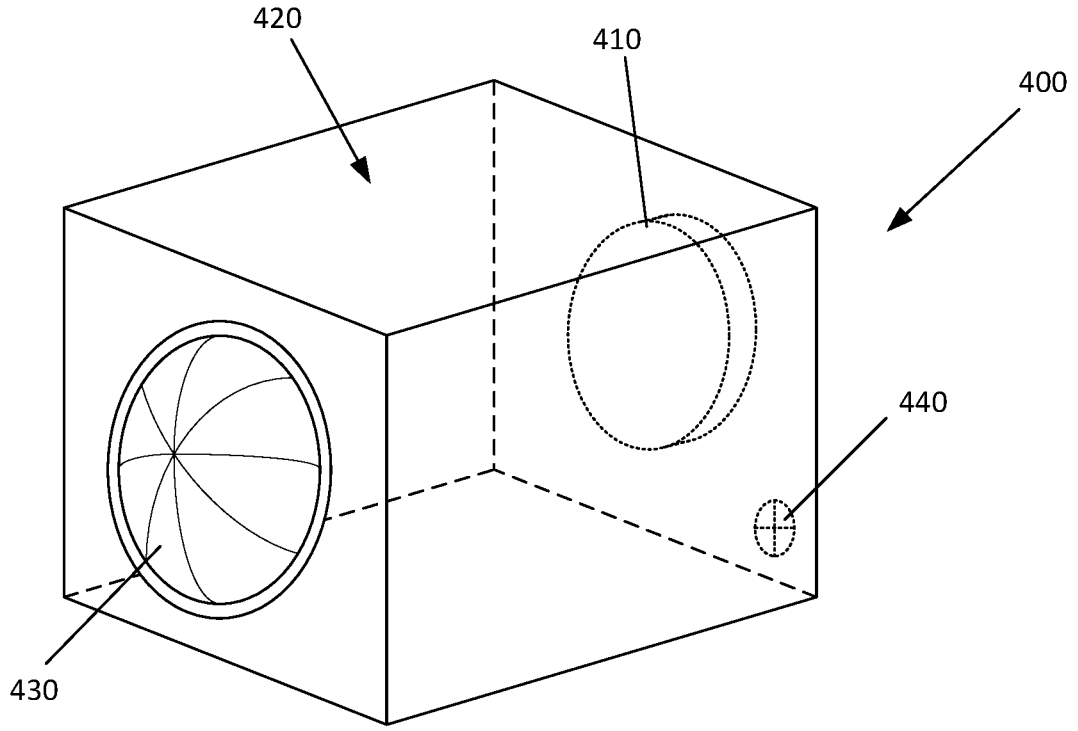
FIGS. 4A and 4B illustrate another example microphone system in the active and de-activated positions.
Figure 4B:
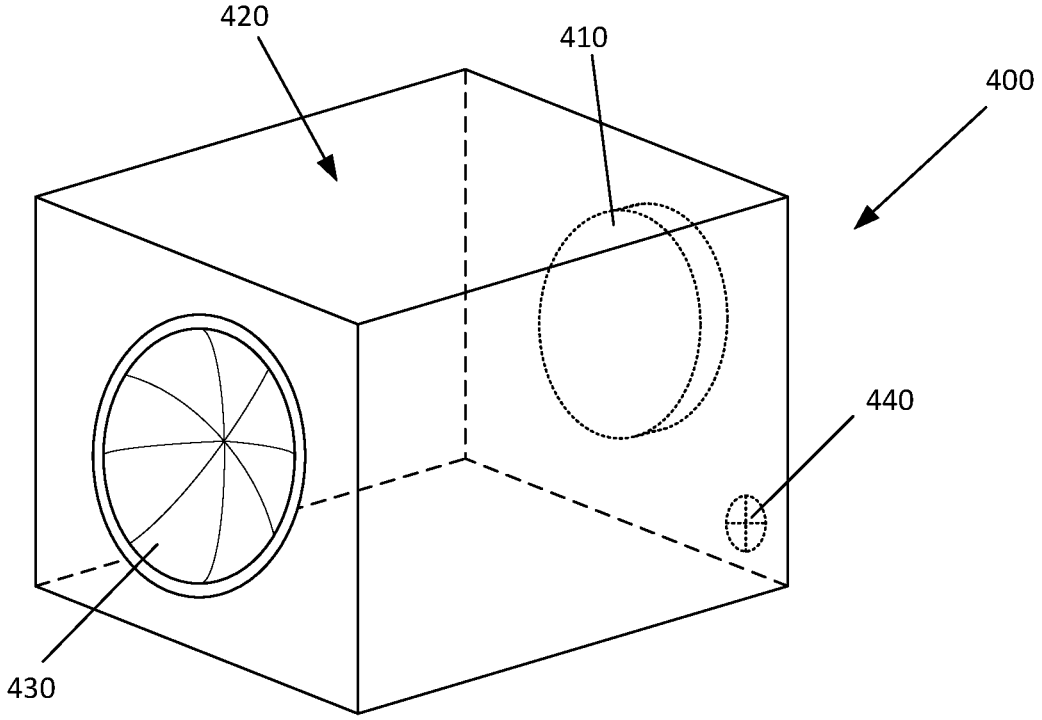

Referring now to FIGS. 4A and 4B, another example microphone system 400 is illustrated in the active position (FIG. 4A) and de-activated position (FIG. 4B). The example system 400 of FIGS. 4A and 4B is similar to the example systems described above with reference to FIGS. 1, 2A, 2B, 3A and 3B and includes a microphone sensor 410, a chamber 420 and a flexible membrane 430 forming an indicator. The example illustrated in FIGS. 4A and 4B is shown with a port 440 to facilitate flow of a fluid into and out of the chamber 420.

In the activated position illustrated in FIG. 4A, the chamber 420 is filled with the fluid. Conversely, FIG. 4B illustrates the de-activated position in which the chamber 420 is evacuated. In the activated position of FIG. 4A with the chamber 420 filled with fluid, the fluid pressure in the chamber 420 causes the flexible membrane 430 to be in a first position. In the example of FIG. 4A, in the first position, the flexible membrane 430 forms a convex surface (outward, or out of the chamber 420). In the de-activated position of FIG. 4B with the chamber 420 evacuated, the vacuum pressure in the chamber 420 causes the flexible membrane 430 to be in a second position. In the example of FIG. 4B, in the second position, the flexible membrane 230 forms a concave surface (inward, or into the chamber 420). Again, as noted above, the first position (concave) is more concave relative to the second position (convex).

Figure 5:
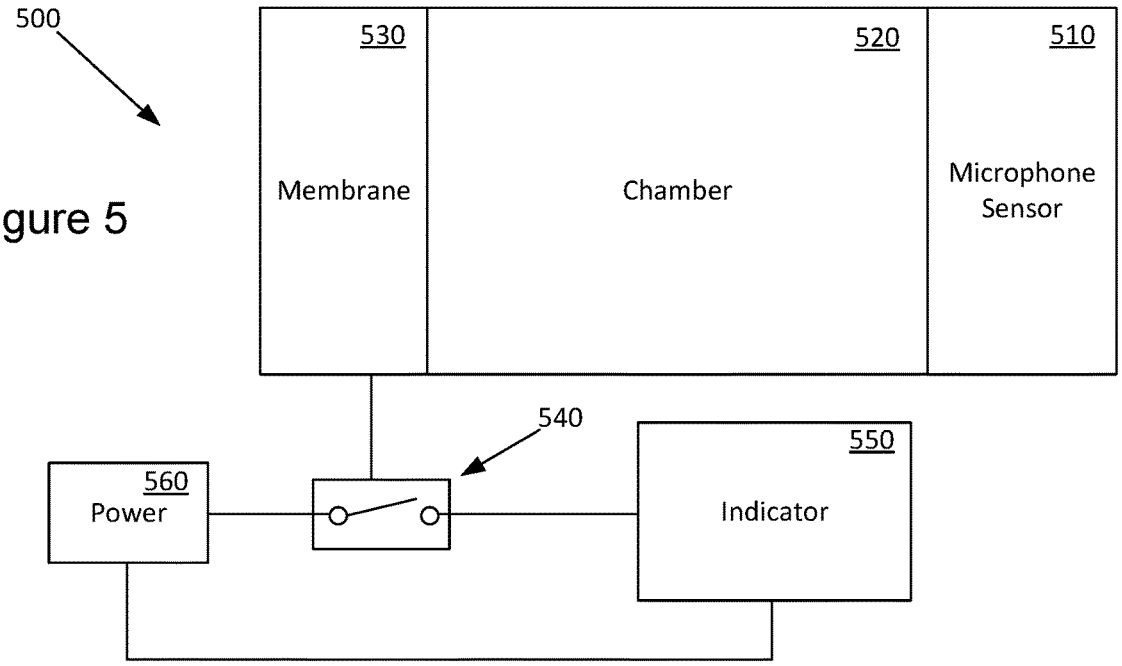
FIG. 5 illustrates another example microphone system.

Referring now to FIG. 5, another example microphone system is schematically illustrated. The example system 500 of FIG. 5 includes a microphone sensor 510, a chamber 520 and a flexible membrane 530. In the example system 500 of FIG. 5, the membrane 530 is coupled to a switch 540 that is coupled to an indicator 550. The indicator 550 may be, for example, a light-emitting diode or other visual indicator.

As noted above, the membrane 530 may move between a first position and a second position when the chamber is filled with fluid or evacuated. In the example system 500 of FIG. 5, mechanical movement of the membrane 530 causes the switch to be either closed or opened. In this regard, the movement of the membrane can result in completion or interruption of a circuit which supplies power from a power supply 560 to the indicator 550.

Figure 6:
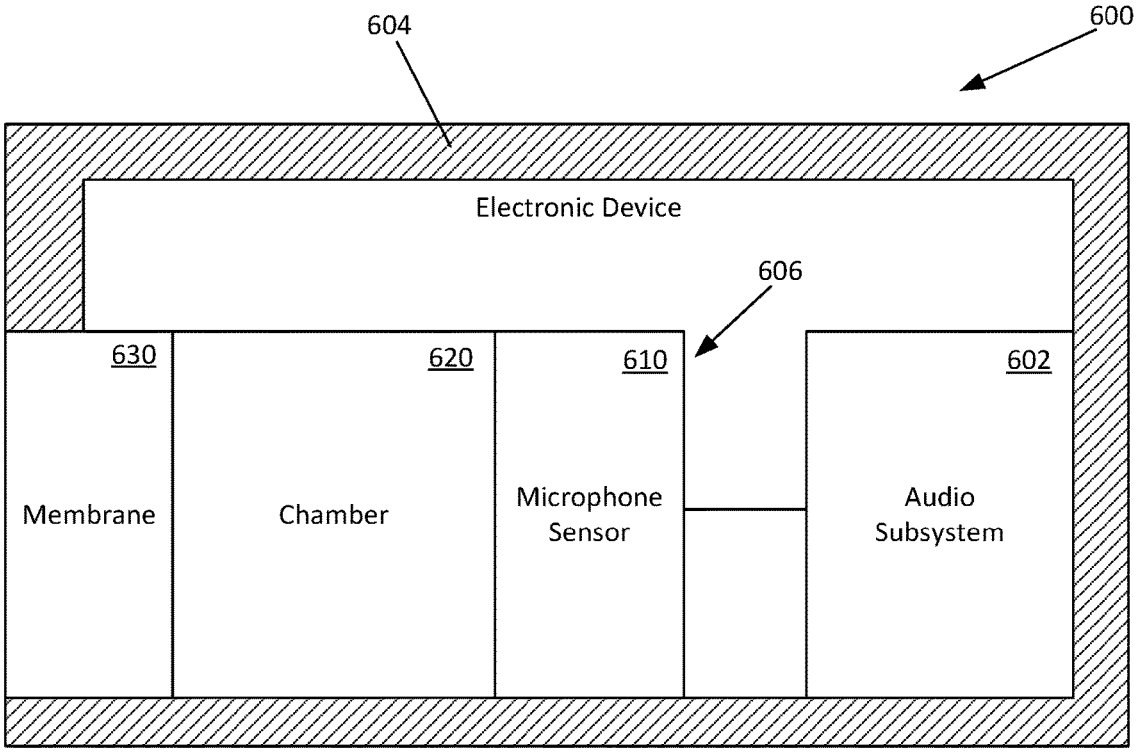
FIG. 6 illustrates an example electronic device with an example microphone system.

Referring now to FIG. 6, an example electronic device 600 with an example microphone system is illustrated. The example electronic device 600 may be any type of electronic device such as a desktop, laptop, mobile phone, tablet or the like. As illustrated in FIG. 6, the example electronic device 600 includes an audio subsystem 602 which may include various components, such as speakers, processors, storage devices, or a voice-recognition system. The example electronic device 600 includes a housing 604 substantially enclosing the various components.

The example electronic device 600 of FIG. 6 includes a microphone assembly 606 which is coupled to the audio subsystem 602. The microphone assembly 606 is provided to receive audio input from, for example, a user for processing by the audio subsystem. The microphone assembly 606 is similar to the example systems described above with reference to FIGS. 1-5. In this regard, the microphone assembly 606 of the example electronic device 600 includes a microphone sensor 610, a chamber 620 and a membrane 630.

As illustrated in FIG. 6, the membrane 630 of the microphone assembly 606 is exposed to the outside of the housing 604, while the microphone sensor 610 is positioned within the housing 604. The chamber 620 acts as a buffer between the membrane 630 and the microphone sensor 610 and can selectively allow or prevent sound waves from passing from the membrane 630 to the microphone sensor 610. Further, the positioning of the membrane 630 as exposed to the outside of the housing allows the membrane 630 to serve as an indicator. As described above, the membrane 630 may be in different positions depending on whether the microphone sensor 610 is activated (with the chamber 620 filled with fluid) or de-activated (with the chamber being evacuated).

Figure 7:
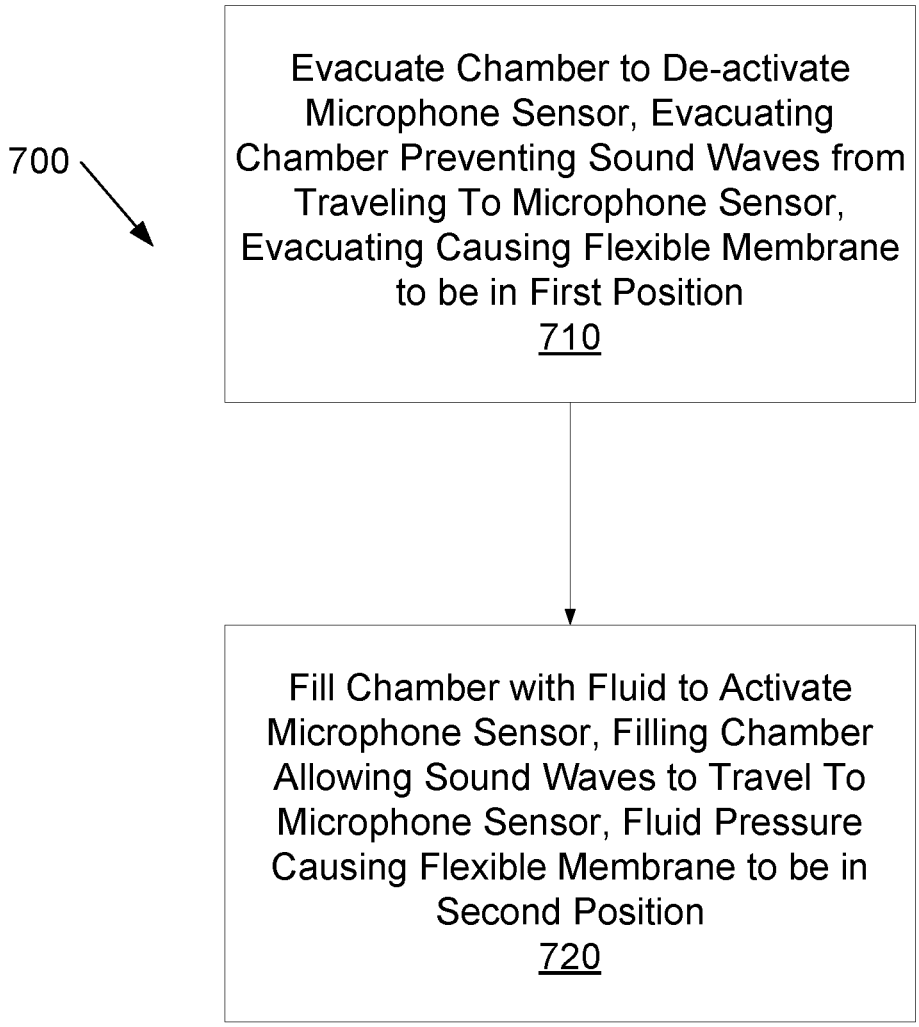
FIG. 7 is a flow chart illustrating an example method for control of a microphone system.

Referring now to FIG. 7, a flow chart illustrating an example method 700 for control of a microphone system is provided. In the example method, a chamber is evacuated when a microphone sensor is to be de-activated (block 710). As described above, the chamber is coupled to a microphone sensor and has a flexible membrane forming at least part of one surface. Evacuating the chamber prevents sounds waves from traveling through the chamber to the microphone sensor and causes the flexible membrane to be in a first position.

The example method 700 includes filling the chamber with a fluid when the microphone sensor is to be activated (block 720). As noted above, filling the chamber with the fluid allows sounds waves to travel through the chamber to the microphone sensor and causes the flexible membrane to be in a second position. As described above, the first position and the second position of the flexible membrane indicate to the user the status of the chamber (either filled with fluid or evacuated) and thus the status of the microphone sensor (either activated or de-activated).

Thus, various examples described above can allow a user to reliably determine whether a microphone is activated or de-activated. Malfunctions due to software bugs, for example, can be eliminated, and hacking is rendered nearly impossible.

The foregoing description of various examples has been presented for purposes of illustration and description. The foregoing description is not intended to be exhaustive or limiting to the examples disclosed, and modifications and variations are possible in light of the above teachings or may be acquired from practice of various examples. The examples discussed herein were chosen and described in order to explain the principles and the nature of various examples of the present disclosure and its practical application to enable one skilled in the art to utilize the present disclosure in various examples and with various modifications as are suited to the particular use contemplated. The features of the examples described herein may be combined in all possible combinations of methods, apparatus, modules, systems, and computer program products.

It is also noted herein that while the above describes examples, these descriptions should not be viewed in a limiting sense. Rather, there are several variations and modifications which may be made without departing from the scope as defined in the appended claims.

What is claimed is:

1. A system, comprising:

a microphone sensor for an electronic device; and a chamber internal to the electronic device and inside which the microphone sensor is located, the chamber to be selectively filled with a fluid or having a vacuum therein; and a port in the chamber through which a pump is to selectively evacuate and maintain a vacuum in the chamber, wherein:

when the chamber is filled with the fluid, sound waves are allowed to travel through the chamber to the microphone sensor and fluid pressure in the chamber causes an indicator to be in a first position, and when the chamber has a vacuum therein, sound waves are prevented from traveling through the chamber to the microphone sensor and the vacuum in the chamber causes the indicator to be in a second position different from the first position.

2. The system of claim 1, wherein the indicator is a flexible membrane forming at least one surface of the chamber, the flexible membrane responsive to fluid pressure or vacuum within the chamber.

3. The system of claim 2, wherein the flexible membrane forms a convex surface in response to air pressure in the chamber and forms a substantially flat surface in response to a vacuum in the chamber.

4. The system of claim 2, wherein the flexible membrane forms a substantially flat surface in response to air pressure in the chamber and forms a concave surface in response to a vacuum in the chamber.

5. The system of claim 2, wherein the flexible membrane forms a convex surface in response to air pressure in the chamber and forms a concave surface in response to a vacuum in the chamber.

6. The system of claim 2, wherein the flexible membrane is to change color is response to surface tension variations resulting from moving between the first position and the second position.

7. The system of claim 2, wherein the flexible membrane is formed of a shape memory material and wherein the shape memory material is formed to have a natural shape corresponding to one of the first position or the second position.

8. The system of claim 1, wherein the fluid is at least one of air, nitrogen, another gas, water or another liquid.

9. The system of claim 1, further comprising:

at least one acoustical isolation feature coupled to the chamber, the acoustical isolation feature being to facilitate isolation of the chamber and the microphone sensor from sound waves.

10. The system of claim 1, further comprising wave absorbing pads on an exterior of the chamber to reduce sound waves traveling as vibration of the chamber.

11. The system of claim 1, wherein the indicator comprises a flexible membrane that has a natural shape that is flat, flat being the first position, and is deformed by to the second position which is concave when the chamber is evacuated.

12. The system of claim 1, wherein the indicator comprises a flexible membrane that has a natural shape that is flat, flat being the second position when the chamber has a vacuum, and that is deformed by pressure in the chamber to the second position which is convex.

13. The system of claim 1, further comprising a switch coupled to the indicator, wherein movement of the indicator in response to pressure or vacuum in the chamber changes a position of the switch.

14. An apparatus, comprising:

an audio subsystem to process audio input; and a microphone assembly to receive audio input for processing by the audio subsystem, the microphone assembly including:

a microphone sensor; and a chamber coupled to the microphone sensor, the chamber to be selectively filled with air or having a vacuum therein, the chamber having a flexible membrane forming at least part of one surface, wherein:

when the chamber is filled with air, sound waves are allowed to travel through the chamber to the microphone sensor and air pressure in the chamber causes the flexible membrane to be in a first position, and when the chamber has a vacuum therein, sound waves are prevented from traveling through the chamber to the microphone sensor and the vacuum in the chamber causes the flexible membrane to be in a second position different from the first position;

wherein the flexible membrane has a natural shape that is flat, flat being the first position, and is deformed by vacuum to the second position which is concave;

wherein the audio subsystem, microphone assembly and chamber are all internal to an electronic device.

15. The apparatus of claim 14, wherein the flexible membrane expresses a first color when the flexible membrane is in the first position and expresses a second color different from the first color when the flexible membrane is in the second position.

16. The apparatus of claim 14, further comprising:

a switch coupled to an indicator, wherein the switch is moved to a first condition by the flexible membrane moving to the first position and moved to a second condition by the flexible membrane moving to the second position.

17. The apparatus of claim 16, wherein the indicator is a light-emitting diode (LED) that is coupled to a power source when the switch is in the first condition and decoupled from the power source when the switch is in the second condition.

18. A method, comprising:

when a microphone sensor is to be de-activated, evacuating a chamber housing the microphone sensor by pumping air from a port in the chamber to evacuate and maintain a vacuum in the chamber, the chamber having a flexible membrane forming at least part of one surface, wherein evacuating the chamber prevents sounds waves from traveling through the chamber to the microphone sensor and causes the flexible membrane to be in a first position; and when the microphone sensor is to be activated, filling the chamber with a fluid using the port, wherein filling the chamber with the fluid allows sounds waves to travel through the chamber to the microphone sensor and causes the flexible membrane to be in a second position.

19. The method of claim 18, wherein the fluid is at least one of air, nitrogen, another gas, water or another liquid.

* * * * *